United States Patent [19]

Mikami

[11] Patent Number: 4,824,754

[45] Date of Patent: Apr. 25, 1989

[54] ELECTROPHOTOGRAPHIC TONER COMPOSITIONS OF PARTICLES COATED WITH METALLIC OXIDES AND TREATED WITH A TITANATE

[75] Inventor: Takeshi Mikami, Fujinomiya, Japan

[73] Assignee: Fuji Photo Film Co., Ltd., Kanagawa, Japan

[21] Appl. No.: 35,740

[22] Filed: Apr. 8, 1987

[30] Foreign Application Priority Data

Apr. 8, 1986 [JP] Japan ..... 61-80637

[51] Int. Cl.[4] ..... G03G 9/08

[52] U.S. Cl. ..... 430/110; 430/903; 430/138; 428/407

[58] Field of Search ..... 430/110, 903, 138; 428/407

[56] References Cited

U.S. PATENT DOCUMENTS

| | | | |
|---|---|---|---|
| 4,108,786 | 8/1978 | Takagama et al. | 430/903 X |
| 4,301,228 | 11/1981 | Kovi et al. | 430/108 X |
| 4,303,749 | 12/1981 | Gruber et al. | 430/110 |
| 4,740,443 | 4/1988 | Nakahara et al. | 430/138 |

FOREIGN PATENT DOCUMENTS

| | | | |
|---|---|---|---|
| 2635091 | 8/1976 | Fed. Rep. of Germany | 430/110 |

*Primary Examiner*—J. David Welsh

*Attorney, Agent, or Firm*—Jules E. Goldberg

[57] ABSTRACT

A toner particle for electrostatography or magnetography which has an inorganic material such as a specific metallic oxide, a carbonate or a silicate in or on its surface. This inorganic material is in the form of particles and has been treated with a titanate coupling agent on its surface.

12 Claims, No Drawings

ELECTROPHOTOGRAPHIC TONER COMPOSITIONS OF PARTICLES COATED WITH METALLIC OXIDES AND TREATED WITH A TITANATE

BACKGROUND OF THE INVENTION

1. Field of the invention

The present invention relates to toner particles employable for producing a visible image from a latent image in an electrostatographic or magnetographic recording method.

2. Description of prior art

As the process for fixing a toner image in a recording method such as electrostatography, there have been known three fixing processes, that is, a heat fixing process, a solvent fixing process and a pressure fixing process. Recently, the heat fixing process and the pressure fixing process, both using no solvent, are widely used from the viewpoint of the prevention of environmental pollution.

In the heat fixing process, a toner comprising a colorant with a binder has been conventionally employed. The conventional toner comprises colorant such as carbon black dispersed in a binder. Such conventional toner has been also employed in the pressure fixing process. However, utilization of an encapsulated toner that is in the form of the micro-capsule containing a colorant in its core portion is recently proposed in the pressure fixing process.

The encapsulated toner is a toner in the form of micro-capsule prepared by enclosing a core material comprising a colorant such as carbon black and a binder such as a polymer and/or an oily liquid with a resin shell which is rupturable by application of pressure.

The known encapsulated toner and the conventional non-encapsulated toner are not necessarily satisfactory in various properties essentially required for electrostatography or magnetography.

For example, a toner employable as a developing agent in electrostatography is required to have various excellent properties such as high powder flowability, high developing efficiency, and no smearing or staining of the surface of a photosensitive member for producing a latent image. This is called "offset phenomenon". Further, in the case of a two-component developing process, it is necessary that the toner does not smear the surface of the employed carrier. In the pressure fixing process, high fixability, little occurrence of offset phenomenon on a press roller used in the process (that is, toner adheres to the surface of press roller to stain the roller), etc. are also required for the toner.

Accordingly, the toner employed in the pressure fixing process should be satisfactory in all properties such as powder flowability, fixability to a supporting medium (e.g., paper), preservation stability of the fixed image, anti-offset property, and electrostatic chargeability and/or conductivity required depending upon a developing process. However, the conventional toners are not well satisfactory in the above-mentioned characteristics.

For instance, decrease of fixing energy is recently desired, because there is a demand to minimize volume of a total system of a duplicating apparatus. In the heat fixing process, it is desired to lower the softening point of fixing components of toner such as polymer and wax for decreasing the fixing energy. However, lowering of the softening point of the component sometimes causes agglomeration of toner particles, because the temperature inside a duplicating apparatus (i.e., copying machine) sometimes increases to a level of from 50° C. to 60° C. due to accumulation of heat of each parts of the apparatus. Moreover, the toner in which a binder component having a low softening point is utilized is apt to adhere to a surface of a heat roller, that is, to cause the offset phenomenon.

The decrease of fixing energy in the pressure fixing process can be accomplished by decreasing the fixing pressure, together with using a toner which is fixable at a low pressure. Such toner can be prepared using a polymer or wax having a low softening point. Such lowering of softening point of a component of a toner is apt to cause the toner agglomeration and offset phenomenon.

The previously proposed encapsulated toners still have the above-mentioned disadvantages, depending on the material of polymer forming the shell.

To solve these problems and improve the flowing property of toner, the encapsulated toner whose shell has a colloidal silica is proposed in Japanese Patent Provisional Publication No. 54(1979)-76233. The toner having a colloidal silica thereon shows an improved flowing property, so long as the toner is not kept for a long period of time. However, this toner is apt to form an agglomerated mass when it is stored for a long period of time at a time temperature such as 60° C. Thereofore, a toner having colloidal silica still has a problem in its storage stability. Also known is a toner having on its surface silica (prepared by a dry process through oxidation of a silicon halide in a vapor phase) which has been treated with a titanate-type coupling agent (i.e., titanate coupling agent), as is described in Japanese Patent Provisional Publications No. 59(1984)-123850. The silica having been treated with a titanate coupling agent serves to improve positive electrochargeability, but is poorly effective to prevent the agglomeration of toner at a high temperature and the offset phenomenon of toner.

SUMMARY OF THE INVENTION

The present invention has an object to provide a toner particle which have improved flowability and is resistant to agglomeration when it is stored at a high temperature.

The invention has another object to provide a toner particle which is almost free from off-setting to a heat roller, or a press roller.

There is provided by the present invention a toner particle wherein said toner particle has at least one metallic oxide selected from the group consisting of oxides of metals belonging to Group Ib, Group IIb, Group IIIb, Group IVb, Group Vb, Group VIb, Group VIIb, and Group VIIIb of Periodic Table in or on its surface, said metallic oxide being in the form of particles and having been treated with a titanate coupling agent on its surface.

There is also provided by the invention a toner particle wherein said toner particle has at least one metallic oxide selected from the group consisting of oxides of Al, Ga, In, Tl, Ge, Sn, Pb, Sb, Bi and Po, said metallic oxide being in the form of particles and having been treated with a titanate coupling agent on its surface.

There is further provided by the invention a toner particle wherein said toner particle has at least one inorganic material selected from the group consisting of carbonates and silicates, said inorganic material being in the form of particles and having been treated with a titanate coupling agent on its surface.

DETAILED DESCRIPTION OF THE INVENTION

At first, the encapsulated toner is described.

The encapsulated toner of the invention has a basic structure comprising a core portion and a shell enclosing the core portion.

The core portion of the encapsulated toner of the invention contains a binder preferably comprising a polymer and/or an oily liquid, and a colorant.

There is no specific limitation with respect to the polymer which is a binder contained in the core portion of the encapsulated toner according to the invention.

Examples of the polymer include polyolefin, olefin copolymer, styrene resin, styrene-butadiene copolymer, epoxy resin, polyester, rubbers, polyvinylpyrrolidone, polyamide, coumarone-indene copolymer, methyl vinyl ether -maleic anhydride copolymer, amino resin, polyurethane, polyurea, homopolymers or copolymers of methacrylic acid esters, homopolymers or copolymers of acrylic acid esters, acrylic acid-long chain alkyl methacrylate copolymer oligomer, polyvinyl acetate, and polyvinyl chloride. These polymers can be employed singly or in combination.

Among these polymers, preferably employable as the polymer for the binder are homopolymer of acrylic acid esters, copolymers of acrylic acid esters with other copolymerizable polymers, homopolymer of methacrylic acid esters, copolymers of methacrylic acid esters with other copolymerizable monomers and styrene-butadiene copolymer.

The oily liquid employable as the binder can be a high-boiling solvent capable of dissolving or swelling the above-described polymer and having a boiling point of not lower than 150° C. (hereinafter referred to simply as high-boiling solvent). Examples of the high-boiling solvents include phthalic acid esters such as diethyl phthalate and dibutyl phthalate; aliphatic dicarboxylic acid esters such as diethyl malonate and dimethyl oxalate; phosphoric acid esters such as tricresyl phosphate and trixylyl phosphate; citric acid esters such as O-acetyl triethyl citrate and tributyl citrate; benzoic acid esters such as butyl benzoate and hexyl benzoate; aliphatic acid esters such as hexadecyl myristate and dioctyl adipate; alkylnaphthalenes such as methylnaphthalene, dimethylnaphthalene, monoisopropylnaphthalene and diisopropylnaphthalene; dialkylphenyl ethers such as dimethylphenyl ether, dimethylphenyl ether and di-p-methylphenyl ether; amides of higher fatty acids or aromatic sulfonic acids such as N,N-dimethyllauroamide and N-butylbenzenesulfonamide; trimellitic acid esters such as trioctyl trimellitate; and diarylalkanes such as diarylmethanes (e.g., dimethylphenylphenylmethane) and diarylethanes (e.g., 1-phenyl-1-methylphenylethane, 1-dimethylphenyl-1-phenylethane and 1-ethylphenyl-1-phenylethane). These high-boiling solvents can be employed singly or in combination.

The encapsulated toner contains an oily liquid as the component of the binder. As the oily liquid, there can be also employed, in combination with the above-mentioned high boiling solvent, an organic liquid substantially neither dissolving nor swelling the polymer contained in the core portion and having a boiling point of 100° C.–250° C. (hereinafter also referred to simply as non-dissolving organic liquid).

Examples of the non-dissolving organic liquids include saturated aliphatic hydrocarbons and mixtures of organic liquids mainly comprising saturated aliphatic hydrocarbons.

The ratio of the non-dissolving organic liquid to the high-boiling solvent can be optionally selected, but preferably is in the range of from 9/1 to 1/9 (high-boiling solvent/non-dissolving organic liquid), by weight.

The binder employed in the invention preferably has a composition comprising the above-mentioned polymer and high-boiling solvent. Also preferred is a binder having a composition comprising the above-mentioned polymer, high-boiling solvent and non-dissolving organic liquid.

The ratio of the polymer to the high-boiling solvent is desirably in the range of 0.1 to 100 (polymer/high-boiling solvent), by weight. The ratio of a combination of the polymer and the high-boiling solvent to the non-dissolving organic liquid is also desirably in the range of 0.1 to 100 (combination of polymer and high-boiling solvent/non-dissolving organic liquid), by weight.

As a colorant contained in the conventional toner for the electrostatography, generally employed are carbon black, grafted carbon black and a chromatic toner such as a blue, red or a yellow colorant. These conventional colorants can be also employed in the encapsulated toner of the invention.

The encapsulated toner of the invention can contain magnetizable particles.

As the magnetizable particles, there can be employed magnetizable particles (particulate material capable of being magnetized) for a conventional magnetic toner. Examples of the magnetizable particles include particles of a simple metal (e.g., cobalt, iron, or nickel), an alloy and a metallic compound. In the case of using a colored magnetizable powder such as a powder of black magnetite, the colored magnetizable powder can serve as magnetizable particles as well as a colorant.

There is no specific limitation with respect to the resin employable for producing a shell of an encapsulated toner, so long as the resin can form a shell around the core material dispersed in the form of oil droplets in an aqueous medium. From the viewpont of various properties required for an encapsulated toner, preferred resins are polyurea resin, polyurethane resin, and polyester resin. These resins can be employed singly or in combination. As the shell material of the encapsulated toner of the invention, polyurea resin or polyurethane resin are desirable from the viewpoint of the strength and the elasticity of the shell. Also preferably employable is a complex shell comprising a polyamide resin in addition to the above-mentioned polyurea resin or polyurethane resin.

The toner particle of the invention has an inorganic material such as a specific metallic oxide, a carbonate or a silicate in or on its surface. This inorganic material is in the form of particles and has been treated with a titanate coupling agent on its surface.

Examples of the specific metallic oxides employable in the invention comprise oxides of metals belonging to Group Ib, Group IIb, Group IIIb, Group IVb, Group Vb, Group VIb, Group VIIb, and Group VIIIb according to Periodic Table. Particularly preferred are oxides of Ti, Zn, Cu and Mn such as $TiO_2$, ZnO, CuO, and $MnO_2$.

Examples of the specific metallic oxides employablve in the invention comprise oxides of Al, Ga, In, Tl, Ge, Sn, Pb, Sb, Bi and Po. Among these metallic oxides, most preferred is $Al_2O_3$.

These metallic oxides can be produced by known processes such as a gaseous phase process comprising reaction of a high purity gas, a metallic alkoxide process comprising hydrolysis of a salt of an organic metallic compound, and a process comprising finely pulverizing a solid material under a specific condition such as at a high temperature and a high pressure.

The inorganic material which can be provided in or on the shell can be carbonates or silicates. The carbonates preferably contain an alkali metal or an alkaline earth metal. Examples of prferred carbonates include $CaCO_3$, $BaCO_3$, and $MgCO_3$. Preferred silicate is aluminum silicate.

Examples of the titanate coupling agents for treating the metallic oxide, carbonate and silicate include isopropyl triisostearoyl titanate, isopropyl tridodecylbenzenesulfonyl titanate, isopropyl tris(dioctylpyrophosphate) titanate, tetraisopropyl bis(dioctylphosphite) titanate, tetraoctyl bis(ditridecylphosophite) titanate, tetra(2,2-diallylhydroxymethyl-1-butyl) bis(ditridecyl)-phosphite titanate, bis(dioctylpyrophosphate)oxyacetate titanate, tris(dioctylpyrophosphate)ethylene titanate, isopropyltrioctanoyl titanate, isopropyldimethacryl isostearoyl titanate, isopropyl isostearoyl diacryl titanate, isopropyl tri(dioctylphosphate) titanate, isopropyl tricumylphenyl titanate, isopropyl tri(N-aminoethylaminoethyl) titanate, dicumylphenyl oxyacetate titanate, and diisostearoylethylene titanate. The titanate coupling agent can be employed singly or in combination.

The titanate coupling agent preferably contains an amino group in the molecular structure. An example of the preferred titanate coupling agent is isopropyl tri(N-aminoethyl-aminoethyl) titanate.

The particles of inorganic material fixed in or on the shell of the toner are as such hydrophilic, but serve to effectively keep the toner from agglomeration at a condition of high humidity or high temperature after having been treated with a titanate coupling agent.

The particles of inorganic material of the invention can be treated with a titanate coupling agent by any one of the following processes: (1) dry process which comprises mixing the particles of inorganic material with a required amount of a liquid titanate coupling agent; (2) solvent slurry process which comprises bringing the particles of inorganic material into contact with a titanate coupling agent dissolved in a great amount of a solvent, and removing the solvent by evaporation or alternatively introducing the resulting dispersion into or onto the shell of toner, and (3) wet process which comprises treating the particles of inorganic material in an aqueous emulsion under vigorous stirring.

The particles of inorganic material preferably have a mean diameter (diameter of primary particle) of not larger than 1 $\mu$m.

The particles of inorganic material treated with the titanate coupling agent are attached onto the shell surface of the encapsulated toner under such conditions that most of the particles are fixed onto the surface of the shell. Otherwise, the particles are contained in the shell wall under such conditions that at least one portion of the particle is embeded in the shell. In the last case, another portion of the particle is preferably exposed on the surface of the shell.

There is no specific limitation with respect to the amount of the particles of inorganic material having been treated with a titanate coupling agent introduced into the toner. However, the amount generally is in the range of 0.05 to 10 weight % based on the amount of the toner particles. Preferred range is from 0.1 to 5 weight %. The use of an extremely small amount of a titanate coupling agent-treated inorganic material such as less than 0.05 weight % is not so effective to improve the flowability of the toner. The use of extremely large amount of the treated particles are not economical.

The process for producing the encapsulated toner of the invention will be described below. The following description is given with respect to the preparation of encapsulated toners having a shell of polyurethane resin and/or polyurea resin, or a shell composed of a complex layer with polyurethane resin and/or polyurea resin, and polyamide resin.

Processes for producing the microcapsules by forming a shell of a polyurethane resin and/or of a polyurea resin around a droplet of a core material comprising a colorant and a binder (optionally, magnetic particles, etc.) in an aqueous medium are already known, and those conventional processes are employable to produce the encapsulated toner of the present invention.

For example, as the process for the preparation of micro-capsules using the polymerization reaction employable for producing the encapsulated toner, an interfacial polymerization process can be mentioned. Also, as other processes for producing micro-capsules using the polymerization reaction employable in the present invention, an internal polymerization process and an external polymerization process can be mentioned.

A shell of polyurea resin and/or polyurethane resin is easily prepared by subjecting a polyisocyanate (e.g., diisocyanate, triisocyanate, tetraisocyanate or a polyisocyanate prepolymer) to the interfacial polymerization reaction in combination with a polyamine (e.g., diamine, triamine or tetraamine), a prepolymer having two or more amino groups, piperazine and a derivative thereof, or polyol in an aqueous solvent.

A shell composed of a complex layer comprising a polyurea resin and/or a polyurethane resin and a polyamide resin (e.g., a complex layer comprising a polyurea resin and a polyamide resin, or a complex layer comprising a polyurethane resin, and a polyamide resin) can be prepared by the following process.

In the case of a shell composed of a complex layer comprising a polyurethane resin and a polyamide resin, the shell can be prepared by the interfacial polymerization comprising the steps of adjusting pH of an emulsified medium for forming a reaction liquid and heating the reaction liquid, using a combination of polyisocyanate and acid chloride, polyamine and polyol. In the case of a shell composed of a complex layer comprising a polyurea resin and a polyamide resin, the shell can be prepared by the interfacial polymerization comprising the steps of adjusting pH of an aqueous medium for forming a reaction liquid and heating the reaction liquid, using a combination of polyisocyanate and acid chloride, and polyamine. Processes for preparing the above-mentioned shell of a complex layer comprising a polyurethane resin and a polyamide resin or a complex layer comprising a polyurethane resin and a polyamide resin are already known. The shell composed of such complex layer is particularly suitable for producing an encapsulated toner containing magnetizable particles in its core portion. A monomer participating in the polymerization reaction for forming a resin shell varies depending upon the shell-forming resin, but generally a combination of two or more monomers is used. An example of such combination is a combination of a compound having at least one bifunctional group selected from the group consisting of isocyanate group, bischloroformate group, acid chloride group and sulfonyl chloride group and at least one compound such as water, polyvalent amine, polyhydric alcohol or polycarboxylic acid.

The micro-capsules prepared as above by forming the shell around the core material are separated from the aqueous medium, and the separated micro-capsules are dried after they are rinsed. The separating and drying the micro-capsules can be done by subjecting the slurry containing micro-capsules to spray drying or heat drying.

The separated and dried micro-capsules can be subjected further to heating process. The characteristics of the particles are very improved by the heating process. It is preferred that the heating process is done at a temperature in the range of 50° C. to 300° C. More preferably, the heating temperature is in the range of 80° C. to 150° C. The period for the heating process can be determined suitably, taking into consideration the heating temperature and the nature of core material used, and it takes usually from 10 minutes to 48 hours, and takes preferably from 2 to 24 hours.

There is no specific limitation with respect to the apparatus or device employable in the drying process. Examples of the devices include an electric furnace, a muffle furnace, a hot plate, an electric dryer, a fluid-bed dryer and an infrared rays dryer.

The particles of inorganic material having been treated with a titanate coupling agent can be mixed with the dried toner using a conventional mixer so that the particles are fixed on the surface of the toner. Alternatively, the dispersion of the microcapsules of toner can be spray-dried together with the treated inorganic mateiral particles to fix the particles onto the toner surface.

The shell of the encapsulated toner of the invention may further contain other optional additives such as an electrostatic charge modifier (e.g., a dye containing metal and nigrosin), if desired. Those additives can be incorporated into the shell at an optional stage of the process such as a shell-forming stage or other stages after the separation and drying procedure.

The non-encapsulated toner is well known with respect to its structure and processes for the preparation already known.

Example of the binder include a homopolymer of styrene and a styrene derivative, a copolymer of styrene or styrene derivative with other copolymerizable monomers. Other employable binders are already known.

As the colorants, the above-mentioned colorants described for the encapsulated toner are mentioned.

The non-encapsulated toner can be provided on or in its surface with the particles of inorganic material having been treated with a titanate coupling agent in the manner as described hereinbefore for the encapsulated toner.

The examples and the comparison examples of the present invention are given below.

Example 1

In an automortar, 40 g of a mixture of 1-isopropylphenyl-2-phenylethane containing 50 wt.% of polyisobutyl methacrylate (trade name: Acrybase, MM-2002-2; available from Fujikura Kasei Co., Ltd.) and Isopar H (tradename of aliphatic saturated hydrocarbon mixture: available from Exxon Chemical Co., Ltd.) in a weight ratio of 6:5 was mixed with 40 g of magnetite particles, to prepare a dispersion (i.e., magnetizable ink).

Individually, 20 g of polyisobutyl methacrylate was dissolved in 9.9 g of an addition compound of 3 mol. of xylylene diisocyanate and 1 mol. of trimethylolpropane (trade name: Takenate D-110N: available from Takeda Chemical Industries Ltd.). The resulting dispersion was mixed with the magnetizable ink to prepare an oily dispersion. The preparation of the oily dispersion (mixture of core material and shell forming material) was done by keeping the dispersion at temperatures of not higher than 25° C.

To 200 g of 4% aqueous solution of methylcellulose (methoxy group substitution degree: 1.8, mean molecular weight: 15,000) was added 0.2 g of diethylenetriamine to prepare an aqueous mixture. The temperature of the aqueous mixture was lowered to less than 15° C.

The above-mentioned oily dispersion was emulsified in the aqueous mixture to obtain an oil-in-water emulsion. The oil droplet had a mean particle size of approx. 12 μm.

At 10 minutes after the preparation of the emulsion, 50 g of 2.5 wt.% aqueous solution of diethylenetriamine was dropwise added into the emulsion, and the mixture was stirred for three hours in a thermostat kept at 60° C. to complete encapsulation reaction.

The obtained micro-capsule dispersion was allowed to stand to precipitate tha microcapsules. The supernatant was then removed. To the remaining portion was added water, and the resulting aqueous dispersion was allowd to stand. Such washing procedure was repeated for twenty times to remove methylcellulose from the micro-capsule surfaces.

The encapsulated toner was well mixed with 1 wt.% of titanium dioxide having been treated with isopropyl tri(N-aminoethytl-aminoethyl) titanate.

It was observed that the toner particles existed independently of each other, and were freely flowable.

Evaluation of Flowablity

The evaluation of flowability of the encapsulated toner was done by measuring both the apparent density and tap density just after the encapsulated toner had been produced (before preservation), as well as after it was preserved at 110° C., 20%RH for 16 hours. The obtained values are introduced into the following equation for calculating a compression ratio.

$$\text{Compression Ratio} = \frac{(\text{tap density}) - (\text{apparent density})}{(\text{tap density})}$$

The apparent density (g/cc) was measured by weighing the accumulated toner which was obtained by placing the toner on a metallic cone sieve (diameter at the top: 72 mm, diameter at the bottom mesh face: 50 mm, height: 50 mm, mesh: 710 μm) and vibrating the sieve slowly to drop the toner into a cylinder container (diameter: 58 mm, height: 75 mm) to yield the accumulated toner in the container.

The tap density was measured by first obtaining the accumulated toner in the same manner as above by placing the toner on the metallic cone sieve and vibrating the sieve slowly to yield the accumulated toner in the container, and subsequently shaking the container violently to harden the toner into a mass.

The results are shown in Table 1.

Example 2

The procedure of Example 1 was repeated except for using calcium carbonate having been treated with isopropyl triisostearoyl titanate instead of titanium dioxide having been treated with isopropyl tri(N-aminoethylaminoethyl) titanate to prepare an encapsulated toner.

It was confirmed that the obtained encapsulated toner particles were independent of each other and showed high flowability. The results of the evaluation are shown in Table 1.

Comparison Example 1

The procedure of Example 1 was repeated except for using untreated titanium dioxide instead of titanium dioxide having been treated with isopropyl tri(N-aminoethyl-aminoethyl) titanate to prepare an encapsulated toner.

It was confirmed that the obtained encapsulated toner particles were independent of each other and showed high flowability. The results of the evaulation are shown in Table 1.

Comparison Example 2

The procedure of Example 1 was repeated except for using silica (tradename: Aerogil #130) having been treated with isopropyl triisostearoyl titanate instead of titanium dioxide having been treated with isopropyl tri-(N-aminoethyl-aminoethyl) titanate to prepare an encapsulated toner.

It was confirmed that the obtained encapsulated toner particles were independent of each other and showed high flowability. The results of the evaluation are shown in Table 1.

TABLE 1

| | Example | | Comparison Example | |
|---|---|---|---|---|
| | 1 | 2 | 1 | 2 |
| Just after production | | | | |
| Apparent density (g/cc) | 0.47 | 0.48 | 0.45 | 0.47 |
| Tap density (g/cc) | 0.74 | 0.75 | 0.73 | 0.73 |
| Compression ratio | 0.36 | 0.36 | 0.38 | 0.36 |
| After storage | | | | |
| Apparent density (g/cc) | 0.47 | 0.47 | 0.40 | 0.39 |
| Tap density (g/cc) | 0.75 | 0.76 | 0.71 | 0.70 |
| Compression ratio | 0.37 | 0.38 | 0.44 | 0.44 |

As it is clear from the results shown in Table 1, the values of the apparent density, the tap density, the compression ratio showed almost no difference between the toners of the invention (Examples 1 and 2) and toners for comparison (Comparison Examples 1 and 2) so long as the toners were measured just after their production and before their storage. However, after the preservation at 110° C., 20%RH for 16 hours, the toners for comparison showed great increase of the compression ratio. This is in contrast to the case for the toners of the invention wherein almost no increase of the compression ratio was observed.

Several reasons why the compression ratio increased can be considered. One of them might be assigned to occurrence of the secondary agglomeration of the toner particles. In more detail, the tap density, the apparent density, and the compressibion ratio closely relate to the flowability and the density of the toner particles.

If the toner particles exist independently to each other and have excellent flowability even after the particles are stored at high temperature, the difference between the tap density and the apparent density does not vary from the values measured before the storage, and further no difference of compression ratio arises. On the contrary, if the toner particles agglomerate and have less flowability after the particles are stored, the difference between the tap density and the apparent density increases, and then the compression ratio increases.

The toner particles of the invention showed almost no variation of the compression ratio after the toner particles are kept at high temperature. Accordingly, it is apparent that the toner particles of the invention have satisfactory preservation stability.

The offset phenomenon was further observed using the toner particles obtained above.

An electrostatographic latent image formed according to an ordinary electrostatographic process was developed with the toner. The toner image was then transferred onto at paper and fixed thereon at pressure of 80 kg/cm. The evaluation on the offset was made by observing whether a paper carrying a toner image was stained by toner particles adhering to the press roller. The results are shown in Table 2.

TABLE 2

| | Example | | Comparison Example | |
|---|---|---|---|---|
| | 1 | 2 | 1 | 2 |
| Stain | None | None | Observed | Observed |

I claim:

1. A toner composition having particles of at least one metallic oxide selected from the group consisting of oxides of Al, Ga, In, Tl, Ge, Sn, Pb, Sb, Bi and Po, fixed on the surface of the toner such that a portion of the particles is exposed, and wherein the surfaces of the particles have been treated with a titanate.

2. The toner particle as claimed in claim 1, wherein said titanate coupling agent contains an amino group in the molecular structure.

3. The toner particle as claimed in claim 1, wherein the content of said metallic oxide having been treated with a titanate coupling agent is in the range of 0.05 to 10 weight % per the whole weight of the toner particle.

4. The toner particle as claimed in claim 1, wherein said particles of metallic oxide comprise primary particles having a mean size of not more than 1 μm.

5. The toner particles as claimed in claim 1 wherein said toner is an encapsulated toner comprising a core and a shell, said core containing an oily binder.

6. The toner particles as claimed in claim 1 wherein said toner is an encapsulated toner comprising a core and a shell, said core containing an oily binder which comprises a polymer, an oily solvent having a boiling point of not lower than 150° C. and being capable of dissolving or swelling the polymer, and an organic liquid having a boiling point in the range of 100° C. to 250° C. and being essentially incapable of dissolving or swelling the polymer.

7. A toner composition having particles of at least one inorganic material selected from the group consisting of carbonates of alkali metals and alkaline earth metals and aluminum silicate fixed on the surface of the toner such that a portion of the particles is exposed, and wherein the surfaces of the particles have been treated with a titanate.

8. The toner particle as claimed in claim 7, wherein said titanate coupling agent contains an amino group in the molecular structure.

9. The toner particle as claimed in claim 7, wherein the content of said inorganic material having been treated with a titanate coupling agent is in the range of 0.05 to 10 weight % per the whole weight of the toner particle.

10. The toner particle as claimed in claim 7, wherein said particles of inorganic material comprise primary particles having a mean size of not more than 1 $\mu$m.

11. The toner particle as claimed in claim 7, wherein said toner is an encapsulated toner comprising a core and a shell, said core containing an oily binder.

12. The toner particle as claimed in claim 7 wherein said toner is an encapsulated toner comprising a core and a shell, said core containing an oily binder which comprises a polymer, an oily solvent having a boiling point of not lower than 150° C. and being capable of dissolving or swelling the polymer, and an organic liquid having a boiling point in the range of 100° C. to 250° C. and being essentially incapable of dissolving or swelling the polymer.

* * * * *